US012790670B2

(12) United States Patent
Kanazawa et al.

(10) Patent No.: US 12,790,670 B2
(45) Date of Patent: Nov. 10, 2026

(54) METAL WIRE

(71) Applicant: Panasonic Intellectual Property Management Co., Ltd., Osaka (JP)

(72) Inventors: Tomohiro Kanazawa, Osaka (JP); Yoshihiro Kodama, Kyoto (JP); Naoki Kohyama, Osaka (JP); Tatsuya Taniwaki, Osaka (JP); Kenshi Tsuji, Osaka (JP); Tomohiro Sawa, Osaka (JP); Tetsuya Nakaaze, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 580 days.

(21) Appl. No.: 18/033,540

(22) PCT Filed: Oct. 4, 2021

(86) PCT No.: PCT/JP2021/036713

§ 371 (c)(1),
(2) Date: Apr. 24, 2023

(87) PCT Pub. No.: WO2022/113525

PCT Pub. Date: Jun. 2, 2022

(65) Prior Publication Data

US 2023/0366068 A1 Nov. 16, 2023

(30) Foreign Application Priority Data

Nov. 27, 2020 (JP) ..... 2020-197402

(51) Int. Cl.
*C22C 27/04* (2006.01)
*C22C 1/04* (2023.01)
*C22F 1/18* (2006.01)

(52) U.S. Cl.
CPC ..... *C22C 27/04* (2013.01); *C22C 1/045* (2013.01); *C22F 1/18* (2013.01)

(58) Field of Classification Search
CPC ..... C22C 27/04; C22C 1/045; C22F 1/18
See application file for complete search history.

(56) References Cited

U.S. PATENT DOCUMENTS

2004/0244879 A1* 12/2004 Tanaka ..... H01J 9/04 148/423
2006/0049761 A1 3/2006 Almanstotter
2019/0232404 A1 8/2019 Kanazawa et al.
(Continued)

FOREIGN PATENT DOCUMENTS

CN 102619342 A 8/2012
CN 209955028 U 1/2020
DE 10 2010 028 206 A1 10/2011
(Continued)

OTHER PUBLICATIONS

International Search Report for corresponding Application No. PCT/JP2021/036713, mailed Nov. 30, 2021.
Shogo Shimizu, et al., "Tungsten Wires Improved in Ductility", Toshiba Review, vol. 23, No. 1, 1968, pp. 68-72 with English machine translation.
Shu Yamazaki, et al., "Influence of Co Addition on the Properties of Doped Tungsten (Part II)", Journal of the Japan Society of Powder and Powder Metallurgy, vol. 19, No. 1, Jun. 1972, pp. 12-17 with English machine translation.
(Continued)

*Primary Examiner* — Adil A. Siddiqui
(74) *Attorney, Agent, or Firm* — Renner, Otto, Boisselle & Sklar, LLP

(57) ABSTRACT

A metal wire has a total elongation of at least 5% and at most 16%; a tensile strength of at least 1600 MPa and at most 2400 MPa; and a diameter of less than 40 μm.

5 Claims, 6 Drawing Sheets

(56) References Cited

U.S. PATENT DOCUMENTS

| | | | |
|---|---|---|---|
| 2022/0098708 | A1 | 3/2022 | Kanazawa et al. |
| 2022/0220591 | A1 | 7/2022 | Kanazawa et al. |

FOREIGN PATENT DOCUMENTS

| | | | |
|---|---|---|---|
| JP | 11-151871 | A | 6/1999 |
| JP | 2010036523 | A | 2/2010 |
| JP | 5722637 | A | 7/2012 |
| JP | 2013-022814 | A | 2/2013 |
| JP | 2014169499 | A | 9/2014 |
| JP | 2015089672 | A | 5/2015 |
| JP | 2020-079471 | A | 5/2020 |
| TW | 202024348 | A | 7/2020 |
| WO | 03/031668 | A1 | 4/2003 |
| WO | 2020/218058 | A1 | 10/2020 |

OTHER PUBLICATIONS

Search Report issued for corresponding Chinese Application No. 202180071455.0, mailed Jun. 17, 2024.

Office Action for the corresponding Taiwanese Application No. 113138397, issued May 2, 2025, with English translation.

Office Action for the corresponding Chinese Application No. 202180071455.0, issued May 29, 2025, with English translation.

Japanese Office Action for the corresponding Japanese Application No. 2024-177839, mailed Jan. 21, 2025.

German Office Action for the corresponding German Application No. 11 2021 006 176.3, mailed Feb. 25, 2026, with Machine Translation.

Nigen Gokin Jyotaizushu (Binary Alloy Phase Diagrams), AGNE Gijutsu Center, 2001, 2 pages.

* cited by examiner

METAL WIRE

TECHNICAL FIELD

The present invention relates to a metal wire.

BACKGROUND ART

Metal wires containing stainless steel or tungsten used for metal mesh applications have been conventionally known (for example, see Patent Literature (PTL) 1-3).

CITATION LIST

Patent Literature

[PTL 1] Japanese Unexamined Patent Application Publication No. 2013-022814
[PTL 2] Japanese Patent No. 5722637
[PTL 3] Japanese Unexamined Patent Application Publication No.

SUMMARY OF INVENTION

Technical Problem

An object of the present invention is to provide a metal wire that is thin and has a large elongation and a high tensile strength.

Solution to Problem

A metal wire according to one aspect of the present invention has a total elongation of at least 5% and at most 16%; a tensile strength of at least 1600 MPa and at most 2400 MPa; and a diameter of less than 40 μm.

Advantageous Effects of Invention

The present invention can provide a metal wire that is thin and has a large elongation and a high tensile strength.

DESCRIPTION OF EMBODIMENTS

Figure 1:
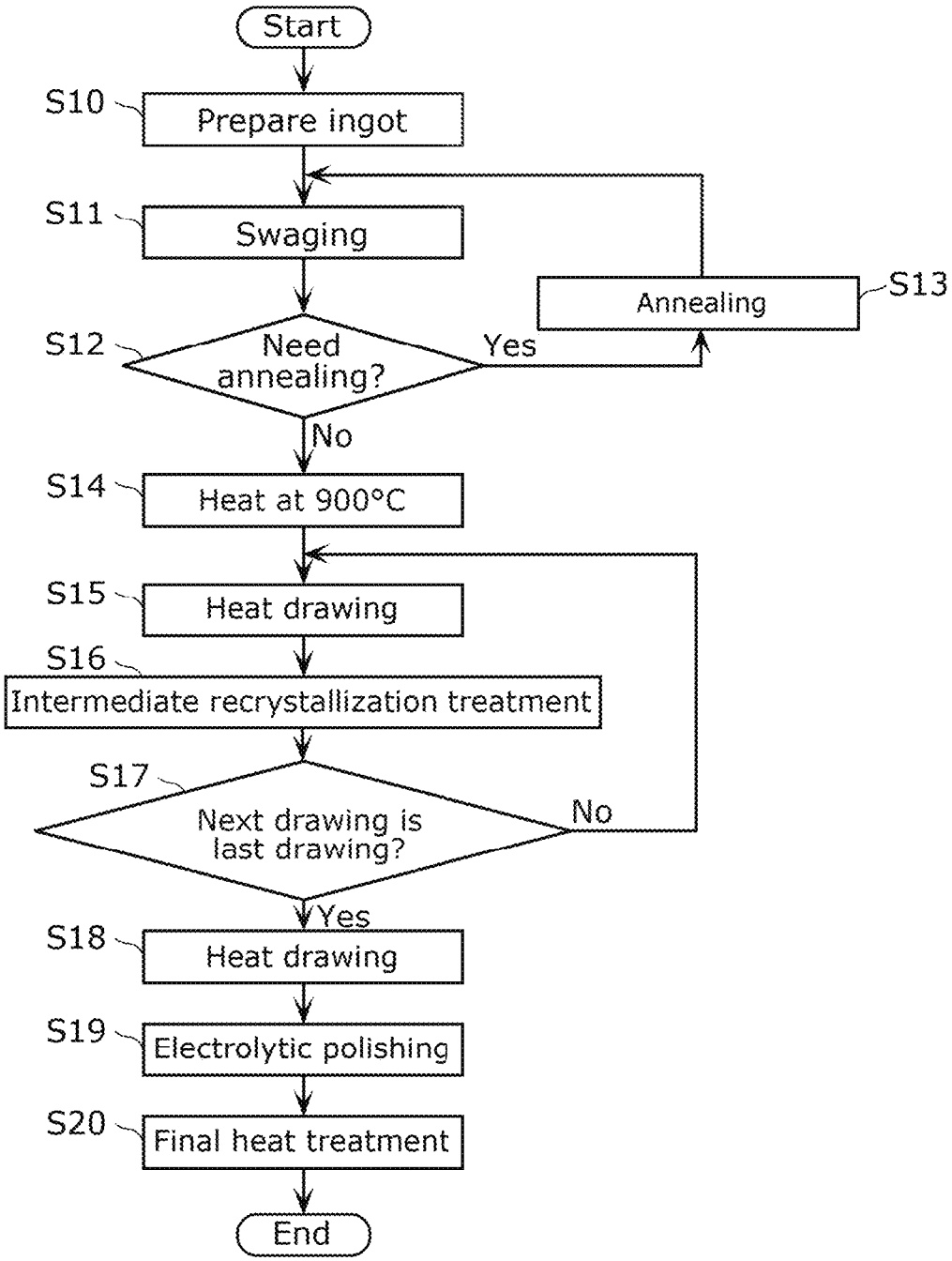
FIG. 1 is a flowchart illustrating an example of a method of manufacturing a metal wire according to an embodiment.

The following describes in detail a metal wire according to an embodiment of the present invention with reference to the drawings. Note that each of the embodiments described below shows a specific example of the present invention. As such, the numerical values, shapes, materials, structural components, the arrangement and connection of the structural components, steps, the processing order of the steps, and so on, shown in the following embodiments are mere examples, and therefore do not limit the present invention. Among the structural components in the embodiments described below, those not recited in the independent claims will be described as optional structural components.

In addition, figures are schematic illustrations and are not necessarily precise depictions. Accordingly, for example, the figures are not necessarily to scale. Moreover, in the figures, structural components that are essentially the same share like reference signs. Accordingly, duplicate description is omitted or simplified.

Moreover, in the present specification, terms representing relationships between structural components, terms representing forms of the structural components, and numerical ranges include, not only the precise meanings, but also substantially equal ranges including, for example, a difference of approximately several percent.

EMBODIMENT

[Metal Wire]

First, a configuration of a metal wire according to an embodiment will be described.

The metal wire according to the present embodiment is an alloy wire containing tungsten (W) and at least one type of metallic element different from tungsten (hereinafter referred to as an alloy element). A tungsten content in the metal wire is, for example, at least 90 wt %. Here, the content is a proportion of a mass of a metallic element (for example, tungsten) with respect to a mass of the metal wire. The tungsten content may be at least 95 wt %, at least 99 wt %, or at least 99.9 wt %. Note that the metal wire may include inevitable elements that cannot be avoided in manufacturing.

Each of the at least one type of alloy element is a metallic element included in Group 7 or Group 8 of the periodic table. Specifically, the alloy element is rhenium (Re) in Group 7 or ruthenium (Ru) in Group 8. For example, the metal wire is an alloy wire of tungsten and rhenium (hereinafter referred to as a rhenium-tungsten alloy wire). Alternatively, the metal wire is an alloy wire of tungsten and ruthenium (hereinafter referred to as a ruthenium-tungsten alloy wire). Note that the metal wire may be an alloy wire of tungsten and two or more types of alloy elements, such as an alloy wire of tungsten, rhenium, and ruthenium.

In the case of the rhenium-tungsten alloy wire, the rhenium content is, for example, at least 0.1 wt % and at most 10 wt %, The rhenium content may be at least 0.5 wt % and at most 9 wt %, or at least 3 wt % and at most 5 wt %. In the case of ruthenium-tungsten alloy wire, the ruthenium content is, for example, at least 0.05 wt % and at most 0.3 wt %. The ruthenium content may be at least 0.1 wt % and at most 0.2 wt %.

The elongation and the tensile strength of the metal wire increase as the rhenium content and/or the ruthenium content increase. However, when the tensile strength increases, the elongation is not likely to be large. In addition, it is more difficult to reduce the diameter of the metal wire as the rhenium content and/or the ruthenium content increase. In the present embodiment, a metal wire having a high tensile strength is achieved as a result of diligent examination and adjusting the contents of the alloy elements and improving a process for reducing the diameter by the inventors of the present application. A specific method of manufacturing the metal wire will be described later.

The metal wire according to the present embodiment has a diameter of less than 40 μm. The diameter of the metal wire may be at most 30 μm or at most 20 μm. For example, the diameter of the metal wire may be at most 18 μm, at most 15 μm, at most 12 μm, or at most 10 μm. The diameter of the metal wire may be small to the processing limit (for example, 5 μm).

The metal wire according to the present embodiment has a total elongation of at least 5%, As a result, when the metal wire is used as warp and weft of the metal mesh, the fracture of the metal wire is inhibited during weaving processing and when the metal mesh is used. The total elongation of the metal wire may be at least 7%, at least 9%, or at least 11%, The effect of inhibiting the fracture of the metal wire increases as the total elongation increases.

On the other hand, if the total elongation is too large, a defect may occur when the metal mesh is used. For example, if the metal mesh is a screen mesh to be used for screen printing, when the metal mesh is pressed by the squeegee, the openings of the metal mesh may spread due to the elongation of the metal wire, and this may deform the form of the ink passing area. In other words, the precision of screen printing may be reduced. In contrast, the total elongation of the metal wire according to the present embodiment is at most 16%. This can increase the precision of screen printing when the metal wire is used for a screen mesh, for example.

Note that total elongation means a total elongation at the time of fracture and is measured by an extensometer, Specifically, the total elongation of the metal wire is a total elongation of the metal wire at the time of fracture, which is the sum of elastic elongation and plastic elongation measured by an extensometer, and is a value expressed as a percentage with respect to an extensometer gauge length.

The tensile strength of the metal wire according to the present embodiment is at least 1600 MPa (=N/mm$^2$) and at most 2400 MPa. As a result, when the metal wire is used as warp and weft of the metal mesh, fracture of the metal wire is inhibited when the metal mesh is used. The tensile strength of the metal wire may be at least 1700 MPa, at least 1800 MPa, at least 2000 MPa, or at least 2100 MPa. The effect of inhibiting the fracture of the metal wire increases as the tensile strength increases. In addition, the durability of the metal mesh woven using a metal wire having a high tensile strength can be enhanced. For example, when the metal mesh is used as a screen mesh, the metal mesh can withstand the pressure of the squeegee. The upper limit of the tensile strength was approximately 2400 MPa in a range in which the total elongation was at least 5% and at most 16% and the diameter was less than 40 μm.

[Manufacturing Method]

Next, a method of manufacturing the metal wire according to the present embodiment will be described with reference to FIG. 1. FIG. 1 is a flowchart illustrating an example of the method of manufacturing the metal wire according to the present embodiment.

As illustrated in FIG. 1, first, a metal ingot is prepared (S10). More specifically, first, a mixture is prepared by mixing a predetermined proportion of tungsten powder and powder containing an alloy metal (for example, rhenium powder or ruthenium powder). The average grain diameter of each powder may be in a range of, for example, at least 3 μm and at most 4 μm, but this is not limiting. An ingot of tungsten alloy is produced by pressing and sintering the prepared mixture. For example, the ingot has a rod shape and the diameter of its section is approximately 15 mm.

Next, swaging processing is performed on the ingot (S11). More specifically, the ingot is press-forged from its periphery and extended to be a tungsten wire having a wire shape. The ingot may be subjected to rolling processing instead of the swaging processing. Swaging processing (S11) and annealing (S13) are repeatedly performed.

Specifically, by repeating the swaging processing, the diameter of the ingot sequentially decreases as follows: 116 mm, 10.6 mm, 8 mm, 6.5 mm, and 13 mm. When the diameter of the ingot reaches one of these diameters (Yes in S12), annealing is performed (S13). The annealing temperature is, for example, 2400° C. After the diameter reaches 3.3 mm, annealing and swaging processing are performed, resulting in a diameter of 3 mm.

Next, a metal wire having a diameter of 3 mm after swaging processing is heated at 900° C. (S14). More specifically, the metal wire is directly heated by a burner, for example. An oxide layer is formed on the surface of the metal wire by heating the metal wire to prevent breakage of the metal wire during the processing in the subsequent heat drawing.

Next, heat drawing is performed (S15). More specifically, drawing of the metal wire, namely, a wire drawing process (reducing the diameter) of the metal wire, is performed using one or more wire drawing dies, while the metal wire is being heated. A heating temperature is, for example, 1000° C. Since the workability of the metal wire enhances as the heating temperature increases, the wire drawing can be performed easily. Heat drawing is repeatedly performed while changing the one or more wire drawing dies. The reduction in area of the metal wire by one wire drawing using a single wire drawing die is, for example, at least 10% and at most 40%. In the heat drawing, a lubricant including graphite dispersed in water may be used.

Next, an intermediate recrystallization treatment is performed on the metal wire after the wire drawing (S16). Specifically, the crystals contained in the metal wire are recrystallized by heating the metal wire at a temperature of at least 1200° C. The heat drawing and the intermediate recrystallization treatment are repeatedly performed until the next drawing is the last drawing (No in S17). The number of repetitions (i.e., the number of intermediate recrystallization treatments) here is, for example, at least 5 and at most 10.

In the repeating of heat drawing, a wire drawing die having a pore diameter smaller than a pore diameter of a wire drawing die used in the drawing immediately before is used. In addition, in the repeating of heat drawing, the metal wire is heated at a heating temperature lower than the heating temperature in the drawing immediately before. For example, the heating temperature in the drawing immediately before the last drawing is lower than the preceding heating temperatures, and is, for example, 400° C.

When the drawing is the last drawing (Yes in S17), heat drawing is performed as the last drawing (S18), This results in a metal wire having a diameter of less than approximately 40 μm.

Next, electrolytic polishing is performed on the metal wire after the drawing (S19). For example, electrolytic polishing is performed by immersing the metal wire and a counter electrode in an electrolyte solution, such as a sodium hydroxide solution, and causing a potential difference between the metal wire and the counter electrode. Electrolytic polishing makes it possible to finely adjust the diameter of the metal wire.

After the electrolytic polishing, final heat treatment is performed on the metal wire (S20), The temperature for the final heat treatment is, for example, at least 1200° C. and at most 1700° C.

Through the above-described processes, the metal wire according to the present embodiment is manufactured. The length of the metal wire immediately after being manufactured through the above-described manufacturing processes is, for example, at least 50 km, and thus is industrially available. The metal wire is cut to an appropriate length according to the aspect in which the metal wire is to be used, and can be used for mesh weaving, for example. As described above, the present embodiment makes it possible to industrially mass-produce the metal wires to be used in various fields, for example, mainly in fields of meshes for screen printing.

Note that, each of the processes described in the method of manufacturing a metal wire is performed, for example, as an in-line process. More specifically, the plurality of wire drawing dies used in step S15 are arranged in order of decreasing pore diameters in the production line. In addition, heating devices such as burners are arranged between the wire drawing dies. The heating devices are arranged for the heat drawing and the intermediate recrystallization treatment. In addition, on the downstream side (post-process side) of the wire drawing die used in step S15, the plurality of wire drawing dies used in step S18 are arranged in order of decreasing pore diameter, and the electrolytic polishing device and the heating device for the final heat treatment are placed on the downstream side of the wire drawing die having the smallest pore diameter. Note that each of the processes may be performed individually.

[Working Examples]

Next, working examples and comparative examples of the metal wire manufactured according to the manufacturing method described above will be described. Metal wires according to Working Examples 1 to 15 and Comparison Examples 1 to 8 described below are obtained by appropriately using different parameters in the manufacturing method (specifically, the diameter, the type of additive, the additive amount, the final heat treatment temperature, and the number of intermediate recrystallization treatments). Specifically, the parameters are as shown in Table 1 and Table 2 below.

TABLE 1

| Working Example No. | Diameter [μm] | Additive | Total elongation [%] | Tensile strength [MPa] | Additive amount [wt %] | Final heat treatment temperature [° C.] | Number of intermediate recrystallization treatments [Number of times] |
|---|---|---|---|---|---|---|---|
| 1 | 11 | Re | 6.9 | 1810 | 5 | 1400 | 8 |
| 2 | | | 7.5 | 1760 | | 1500 | |
| 3 | 12 | | 5.5 | 1740 | 3 | 1550 | 10 |
| 4 | 18 | | 11.8 | 1790 | 5 | 1600 | 7 |
| 5 | 35 | | 7.9 | 1920 | 3 | | 6 |
| 6 | | | 11.7 | 1810 | | 1700 | |
| 7 | | | 5.0 | 2120 | 5 | 1300 | |
| 8 | | | 7.1 | 2030 | | 1400 | |
| 9 | | | 13.8 | 1790 | | 1600 | |
| 10 | | | 5.1 | 1960 | 3 | 1700 | 5 |
| 11 | | Ru | 5.6 | 2200 | 0.2 | 1200 | 6 |
| 12 | | Re | 11.3 | 1930 | 5 | 1500 | 5 |
| 13 | | | 16.0 | 1740 | | 1600 | |
| 14 | | | 6.0 | 2110 | 9 | | 7 |
| 15 | | | 11.9 | 2050 | | 1700 | |

TABLE 2

| Comparative Example No. | Diameter [μm] | Additive | Total elongation [%] | Tensile strength [MPa] | Additive amount [wt %] | Final heat treatment temperature [° C.] | Number of intermediate recrystallization treatments [Number of times] |
|---|---|---|---|---|---|---|---|
| 1 | 35 | Re | 2.0 | 2400 | 5 | 1200 | 5 |
| 2 | | | 2.5 | 2190 | | 1400 | |
| 3 | | | 1.4 | 2010 | 3 | 1600 | 3 |
| 4 | | | 0.9 | 1620 | | 1700 | |
| 5 | | | 1.2 | 1850 | 5 | | |
| 6 | 18 | | 1.2 | 2030 | | 1500 | 4 |
| 7 | | | 1.6 | 1840 | | 1550 | |
| 8 | 12 | | 1.1 | 2160 | | 1500 | 5 |

Figure 2:
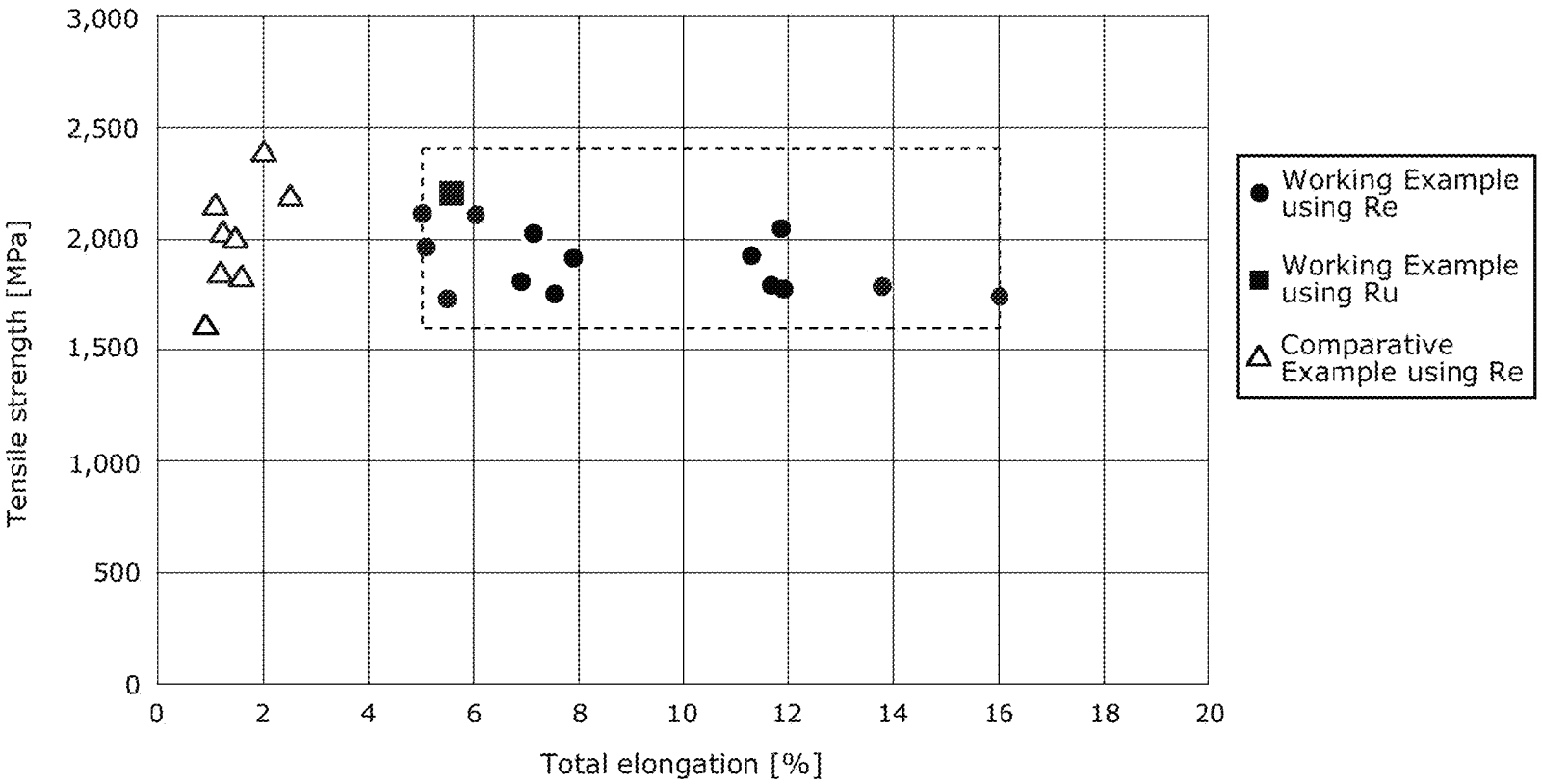
FIG. 2 is a scatter diagram showing the relationships between the total elongation and the tensile strength of metal wires according to working examples and comparative examples.

FIG. 2 is a scatter diagram showing the relationships between the total elongation and the tensile strength of metal wires according to the working examples and the comparative examples. In FIG. 2, a total elongation of a metal wire is represented on the horizontal axis, and a tensile strength of a metal wire is represented on the vertical axis.

Each of the metal wires according to Working Examples 1 to 15 has a diameter of less than 40 μm. As shown in FIG. 2, all the metal wires according to the working examples fall within the following range: the tensile strength is at least 1600 MPa and at most 2400 MPa and the total elongation is at least 5% and at most 16%. Note that FIG. 2 shows the above-described range of the tensile strength and the total elongation by dashed lines. On the other hand, the metal wires in Comparison Examples 1 to 8 are outside the range shown by the dashed lines in FIG. 2.

The following describes the factors causing the differences between the working examples and the comparative examples, and the results of examinations on the parameters of an assumed method of manufacturing a metal wire.

<Additives>

First, the types of alloy elements, which are additives, and the amounts of additives (contents in metal wires) are described. Table 1 shows that the total elongation tends to increase when the additive amount of the alloy element is increased.

In Working Example 5 and Working Example 9 in Table 1, the diameter is 35 μm, the additive is Re, the final heat treatment temperature is 1600° C., and the number of intermediate recrystallization treatments is 6. Other than the additive amount of Re, the parameters are the same. Comparison between Working Example 5 and Working Example 9 shows that the total elongation is larger and the tensile strength is lower in Working Example 9 than in Working Example 5. In Working Example 9, the additive amount of Re is greater.

Therefore, when the additive amount of the alloy element is increased, the total elongation can be increased while the tensile strength of at least 1600 MPa is achieved. Conversely, when the additive amount of the alloy element is reduced, the tensile strength can be increased while the total elongation of at least 5% is achieved.

Note that, when Ru is used as an additive as in Working Example 11, a large total elongation and a large tensile strength can both be achieved even when the additive amount is approximately one order of magnitude smaller than the additive amount of Re.

<Final Heat Treatment Temperature>

Next, the final heat treatment temperature will be described. Table 1 shows that the total elongation tends to increase as the final heat treatment temperature increases.

Moreover, in Working Example 1 and Working Example 2 in Table 1, the diameter is 11 μm, the additive is Re, the additive amount is 5 wt %, and the number of intermediate recrystallization treatments is 8. Other than the final heat treatment temperature, the parameters are the same. Comparison between Working Example 1 and Working Example 2 shows that the total elongation is larger and the tensile strength is lower in Working Example 2 than in Working Example 1. In Working Example 2, the final heat treatment temperature is higher. Working Example 5 and Working Example 6 have the same parameters other than the final heat treatment temperature and have a similar tendency. Regarding the group of Working Examples 7 to 9, the group of Working Examples 12 and 13, and the group of Working Examples 14 and 15, each group has the same parameters other than the final heat treatment temperature and has a similar tendency. A similar tendency appears in cases where the diameter is 11 μm (Working Examples 1 and 2) and where the diameter is 35 μm (Working Example 5, for example).

In view of the above, when the final heat treatment temperature is increased, the total elongation can be increased while the tensile strength of at least 1600 MPa is achieved, regardless of the size of the diameter of the metal wire. Conversely, when the final heat treatment temperature is lowered, the tensile strength can be further increased while the total elongation of at least 5% is achieved, regardless of the size of the diameter of the metal wire.

Note that, other than the final heat treatment temperature, Comparative Examples 1 and 2 in Table 2 have the same parameters as in Working Examples 12 and 13 in Table 1. However, the total elongation in Comparative Examples 1 and 2 is less than 5%, The final heat treatment temperature in each of Comparative Examples 1 and 2 is 1400° C. or less. Accordingly, at least when the diameter is 35 μm, 5 wt % of Re is added, and the intermediate recrystallization treatment is performed 5 times, the total elongation can be increased to 5% or more with the final heat treatment temperature of greater than 1400° C., preferably 1500° C. or more.

Note that, when Ru is used as an additive as in Working Example 11, a large total elongation and a large tensile strength can both be achieved even when the final heat treatment temperature is 1200° C.

<The Number of Intermediate Recrystallization Treatments>

Next, the number of intermediate recrystallization treatments will be described. Table 1 shows that the total elongation tends to increase as the number of intermediate recrystallization treatments increases. More specifically, when the number of intermediate recrystallization treatments is 5 or more, the total elongation can be increased to 5% or more.

In Working Example 6 and Working Example 10 in Table 1, the diameter is 35 μm, the additive is Re, the additive amount is 3 wt %, and the final heat treatment temperature is 1700° C. Other than the number of intermediate recrystallization treatments, the parameters are the same. Comparison between Working Example 6 and Working Example 10 shows that the total elongation is larger and the tensile strength is lower in Working Example 6 than in Working Example 10. In Working Example 6, the number of intermediate recrystallization treatments is greater. Conversely, when the number of intermediate recrystallization treatments is reduced, the tensile strength can be increased while the total elongation of 5% or more is achieved.

Note that other than the number of intermediate recrystallization treatments, the parameters of Comparative Example 4 in Table 2 and the parameters of Working Examples 6 and 10 in Table 1 are the same. In this case, however, the total elongation and the tensile strength in Working Examples 6 and 10 are both larger than the total elongation and the tensile strength in Comparative Example 4. In Working Examples 6 and 10, the number of intermediate recrystallization treatments is 5 or more, whereas in Comparative Example 4, the number of intermediate recrystallization treatments is 3. This shows that when the number of intermediate recrystallization treatments is 3 or less, the total elongation cannot be increased to 5% or more.

Table 1 also shows that the required number of intermediate recrystallization treatments differs according to difference in diameter of the metal wires. More specifically, when the diameter is in the range of at least 11 μm and at most 18 μm, the total elongation is increased to 5% or more when the number of intermediate recrystallization treatments is 8 or more. On the other hand, when the diameter is 35 μm, the total elongation is increased to 5% or more when the number of intermediate recrystallization treatments is 5 or more. Based on this point, in order to obtain a metal wire having a thin diameter, it can be understood that the number of intermediate recrystallization treatments only needs to be increased than in the case of obtaining a metal wire having a thick diameter.

Note that recrystallization treatment is a process of rearranging crystals by heat treatment. The recrystallization treatment accelerates the dispersion of a solid-solute element, such as Re or Ru, and contributes to an increase in total elongation when the diameter of the metal wire is reduced. As described above, applying heat to the metal wire as recrystallization treatment in the manufacturing procedure improves the dispersion of an alloy element (Re or Ru) in the metal wire. As a result, since it is possible to inhibit uneven distribution of the alloy element, it is possible to achieve a thin metal wire having both an improved tensile strength and an increased total elongation.

[Use Example of Metal Wire]

Next, a use example of the metal wire according to the present embodiment will be described.

Figure 3:
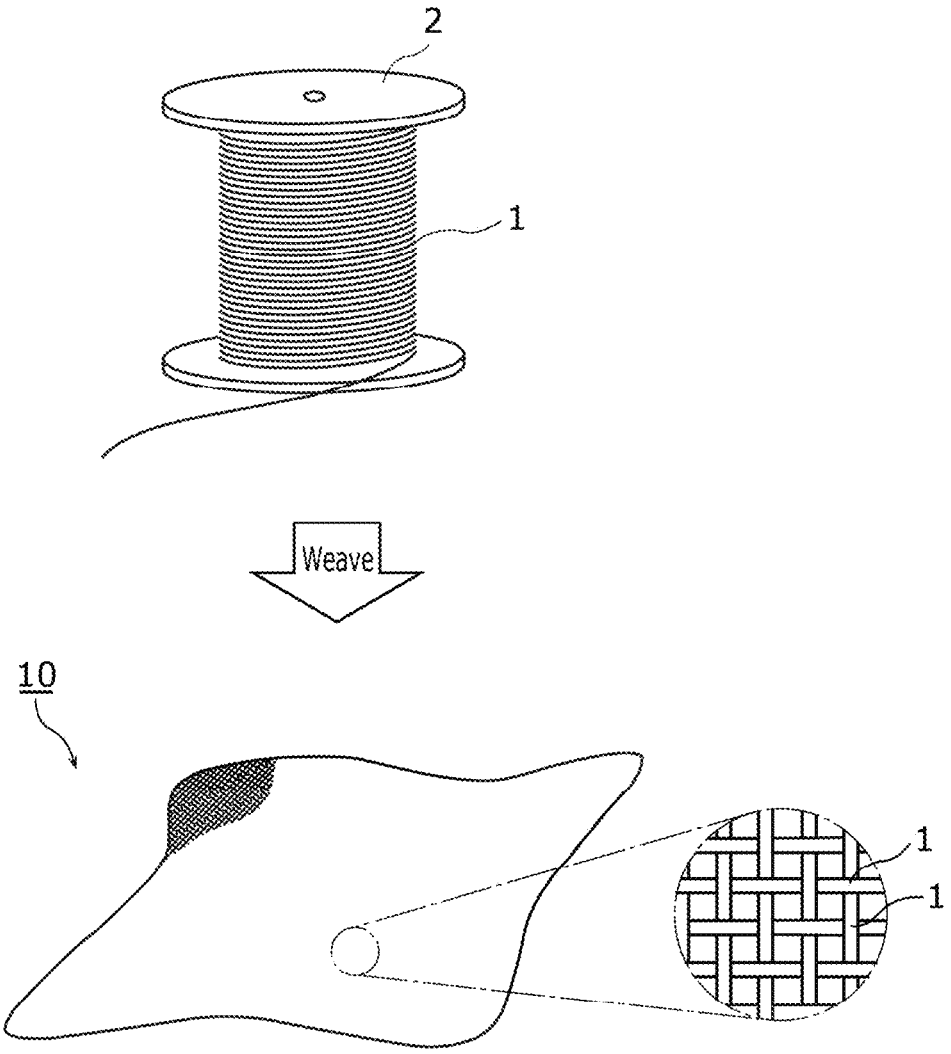
FIG. 3 is a perspective view illustrating the metal wire according to the embodiment and a metal mesh woven using the metal wire.

The metal wire according to the present embodiment can be used for various applications. FIG. 3 is a perspective view illustrating metal wire 1 according to the present embodiment and metal mesh woven using metal wire 1.

As illustrated in FIG. 3, the manufactured metal wire 1 is generally wrapped around bobbin (spool) 2 and stored. When metal wire 1 is used to manufacture a desired metal product, metal wire 1 is unwound from bobbin 2.

For example, metal mesh 10 can be produced by performing weaving using metal wire 1 as at least one of weft or warp. Metal mesh 10 is an example of a tungsten product including metal wire 1, and is, for example, a screen mesh used for screen printing. As described above, metal wire 1 is used as a wire rod for a screen mesh. Note that metal mesh 10 may be used not only for a screen mesh but also for a high-performance filter or medical equipment, for example.

[Bendability of Metal Wire]

Figure 4:
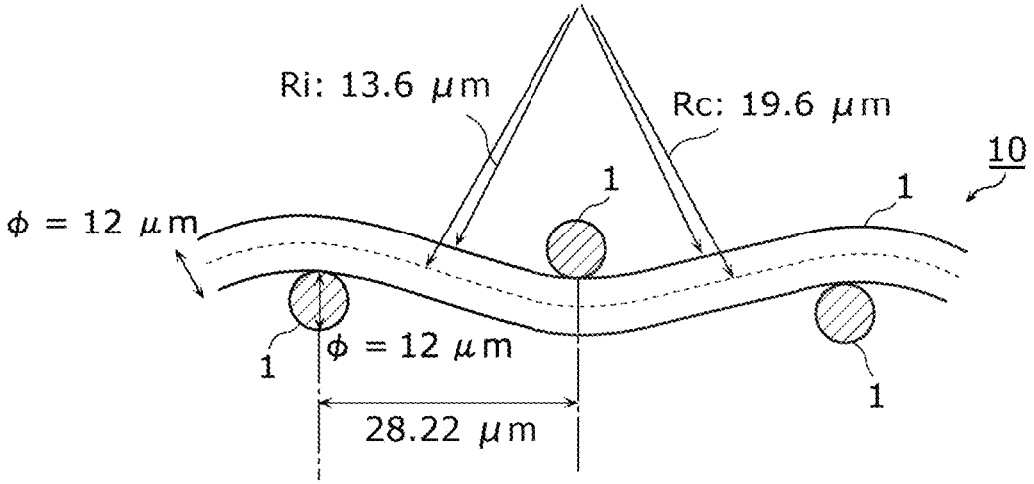
FIG. 4 is a sectional view of the metal mesh using the metal wire according to the embodiment.
Figure 5:
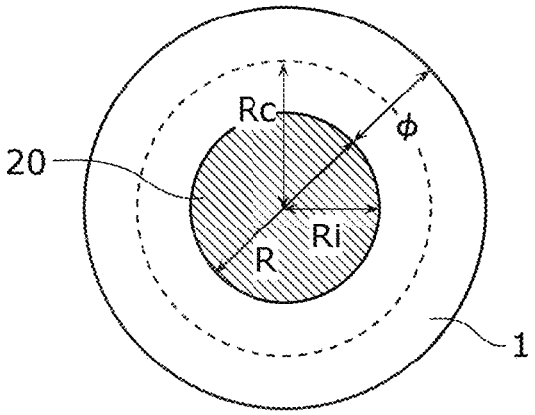
FIG. 5 is a diagram illustrating an outline of a coiling test for the metal wire according to the embodiment.

Next, the bendability of the metal wire will be described with reference to FIG. 4 and FIG. 5, FIG. 4 is a sectional view of metal mesh 10 woven using metal wire 1 according to the present embodiment. As shown in FIG. 4, in metal mesh 10, metal wire 1 woven as warp and weft is bent. Therefore, metal wire 1 is required to withstand bending to at least a predetermined curvature.

The inventors of the present application performed a coiling test to check the bendability of metal wire 1. The following describes the details of the coiling test and the results, FIG. 5 is a diagram illustrating an outline of the coiling test for metal wire 1 according to the embodiment. In the coiling test, metal wire 1 was wound around core material 20, which is rod-shaped and has a circular sectional shape with a uniform diameter, and whether metal wire 1 fractured or the surface delamination occurred was checked. Diameter R of the section of core material 20 and diameter φ of metal wire 1 used in the coiling test are determined according to specifications of metal mesh 10 to be manufactured.

As an example of metal mesh 10 to be manufactured, a 900-mesh metal mesh is manufactured using metal wire 1 having a diameter of 12 μm. Note that the mesh (mesh number) here refers to the number of wires per 25.4 mm (1 inch). In this case, the pitch, which is the distance between two adjacent metal wires 1, is 28.2 μm (=25.4 mm÷900).

In this case, as illustrated in FIG. 4, radius of curvature Rc of metal wire 1 is 19.6 μm. Note that radius of curvature Rc is defined based on the central axis of metal wire 1 (dashed line in the figure). Inner radius of curvature Ri of metal wire 1 is 13.6 μm. Inner radius of curvature Ri is defined based on the inner surface of the bending of metal wire 1. In other words, if metal wire 1 does not fracture and surface delamination does not occur when metal wire 1 is bent until radius of curvature Rc reaches 19.6 μm or less and inner radius of curvature Ri reaches 13.6 μm or less, metal wire 1 can be used as warp and weft of metal mesh 10.

The coiling test was performed under a condition beyond the weavable limit as a metal mesh. If no fracture (breakage) or surface delamination of metal wire 1 occurs as a result of the coiling test performed under the condition beyond the weavable limit, metal wire 1 used in the test can be used to stably manufacture metal mesh 10.

For example, a condition in which metal wires 1 each having a diameter of 12 μm are brought in contact with each other is the case where the mesh number is 1222. In other words, it is not possible to manufacture a metal mesh whose mesh number is 1222 or more. As a condition for the coiling test, metal mesh 10 that includes metal wire 1 having a diameter of 12 μm and whose mesh number is 1324 is assumed.

Since metal wire 1 breaks due to distortion of the materials included in metal wire 1, it is possible to examine the breakage using metal wire 1 having a different diameter. For example, if the condition of 1324 mesh and a diameter of 12 μm is converted to metal wire 1 having a diameter of 35 μm, the result is 454 mesh (=1324 mesh×12 μm÷35 μm). Under this condition, radius of curvature Rc is 31 μm and inner radius of curvature Ri is 13.5 μm.

In the coiling test, the inventors of the present application used core material 20 having diameter R=27 μm and metal wire 1 having a diameter φ=35 μm. Metal wire 1 wound around core material 20 has inner radius of curvature Ri of 13.5 μm (=R÷2) and radius of curvature Rc of 31.0 μm (=Ri+φ÷2). This means that if no fracture or surface delamination occurs in the coiling test under this condition, a 900-mesh metal mesh 10 can be manufactured using metal wire 1 having a diameter of 12 μm.

Table 3 below shows the results of the coiling test performed for Comparative Examples 9 and 10 and Working Example 16. Note that in all these examples, the diameter of the metal wire is 35 μm, and the alloy element used as the additive is Re, and the amount of the additive is 5 wt %. The number of intermediate recrystallization treatments was 6 in all these examples.

TABLE 3

| No. | Total elongation [%] | Tensile strength [MPa] | Final heat treatment temperature [° C.] | Fracture | Surface delamination |
|---|---|---|---|---|---|
| Comparative Example 9 | 3 | 2160 | 1200 | Fractured | — |
| Comparative Example 10 | 4 | 2130 | 1300 | Not fractured | Slightly occur |
| Working Example 16 | 5 | 2100 | 1400 | Not fractured | None |

Figure 6A:
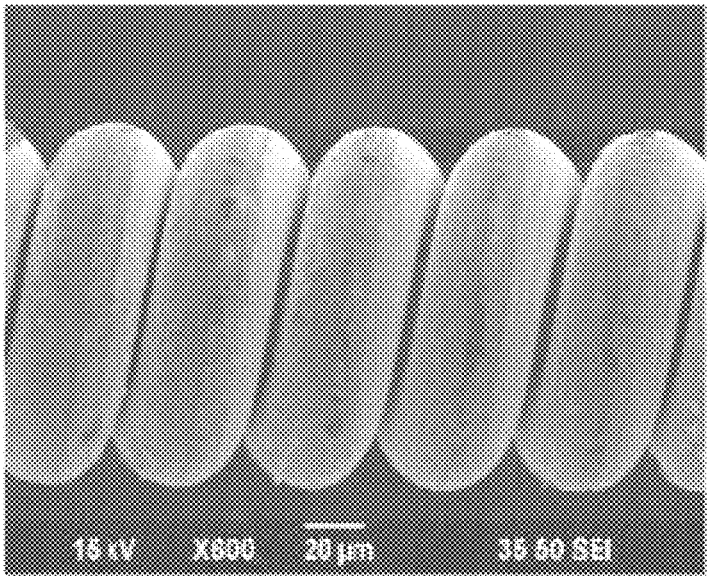
FIG. 6A is a diagram showing an external appearance of a metal wire according to Working Example 16 after the coiling test.
Figure 6B:
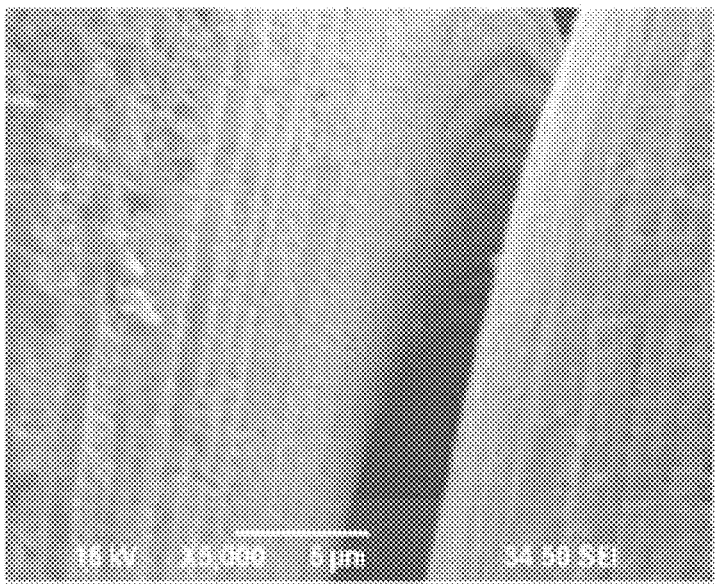
FIG. 6B is an enlarged view of a part of FIG. 6A.

FIG. 6A is a diagram showing an external appearance of a metal wire according to Working Example 16 after the coiling test. FIG. 6B is an enlarged view of a part of FIG. 6A, As shown in FIG. 6A and FIG. 6B, there was no fracture or surface delamination of the metal wire in Working Example 16.

Figure 7A:
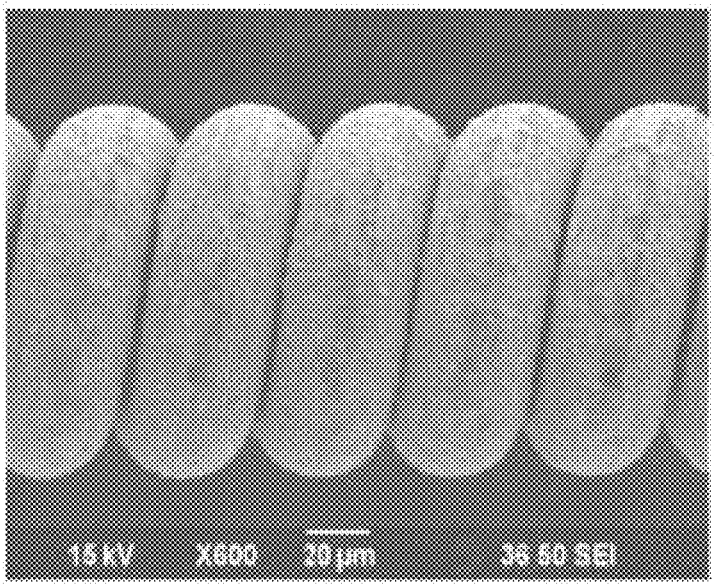
FIG. 7A is a diagram showing an external appearance of a metal wire according to Comparative Example 10 after the coiling test.
Figure 7B:
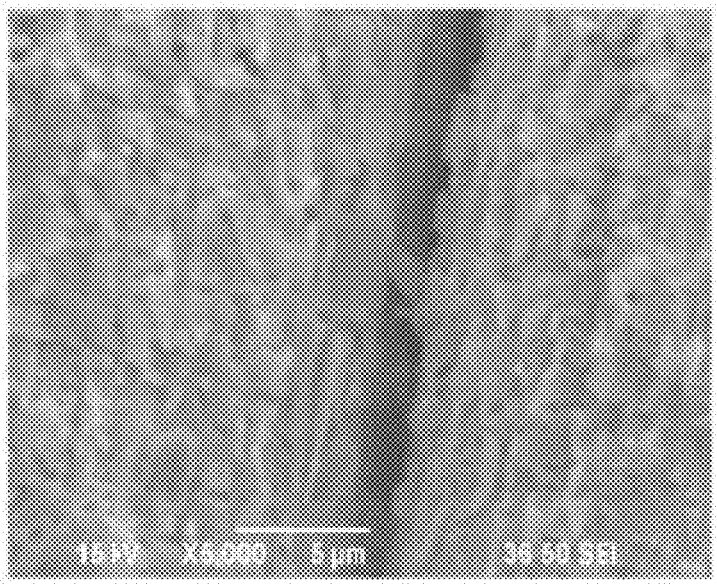
FIG. 7B is an enlarged view of a part of FIG. 7A.

FIG. 7A is a diagram showing an external appearance of a metal wire according to Comparative Example 10 after the coiling test. FIG. 7B is an enlarged view of a part of FIG. 7A. As shown in FIG. 7A and FIG. 7B, regarding the metal wire in Comparative Example 10, there was no fracture but surface delamination slightly occurred. Therefore, metal mesh 10 can be manufactured even when the total elongation is 4%. However, the total elongation of 5% or more is desirable to manufacture a better-quality metal mesh 10.

Note that the diameter of the metal wire and the pitch of the mesh are not limited to the above examples.

[Advantageous Effects, Etc.]

As described above, the metal wire according to the present embodiment has a total elongation of at least 5% and at most 16%; a tensile strength of at least 1600 MPa and at most 2400 MPa; and a diameter of less than 40 μm. Moreover, for example, the metal wire may be used as warp or weft of a mesh.

As described above, a metal wire that is thin and has a large elongation and a high tensile strength can be achieved. In particular, when the metal wire is used as warp and weft of a mesh, a fine mesh can be formed because the metal wire is thin. When this mesh is used as a screen mesh, high-definition printing can be performed. In addition, since the elongation of the metal wire is large, it is possible to inhibit fracture of the metal wire during weaving processing using the metal wire as warp and weft. It is also possible to inhibit fracture of the woven metal mesh 10 when the woven metal mesh 10 is used.

In addition, the metal mesh woven by using the metal wire having a high tensile strength as warp and weft can inhibit fracture during use and enhance durability. For example, when a metal mesh is used as a screen mesh, the metal mesh can withstand pressure of a squeegee. As described above, the mesh woven using the metal wire according to the present embodiment has high durability and can be used to perform high-definition printing.

Moreover, for example, the metal wire is an alloy wire containing an alloy of tungsten and at least one type of metallic element different from tungsten. Moreover, for example, each of the at least one type of metallic element is a Group 7 element or a Group 8 element. Moreover, for example, each of the at least one type of metallic element is rhenium or ruthenium.

With this configuration, by dispersing the alloy element in the metal wire with minimal unevenness, it possible to increase elongation while a high tensile strength is maintained.

Moreover, for example, the metal wire does not fracture when the metal wire is bent until an inner radius of curvature of the metal wire reaches a predetermined value of 13.6 μm or less. The predetermined value is, for example, 13.5 μm.

This makes it possible to stably manufacture a metal mesh equivalent to a 900-mesh metal mesh.

Moreover, for example, the diameter of the metal wire may be 18 μm or less.

For example, this makes it possible to manufacture a finer mesh using the metal wire. When the metal wire is used as a screen mesh, high-definition printing can be achieved.

[Others]

Although the metal wire according to the present invention has been described based on the above-described embodiment, the present invention is not limited to the above-described embodiment.

For example, the alloy element may be a Group 7 element other than rhenium (for example, technetium [Tc]), or a Group 8 element other than ruthenium (for example, osmium [Os]), In addition, for example, the alloy element may be an element different from Group 7 elements or Group 8 elements (for example, iridium [Ir]).

In addition, for example, the metal wire may be used for applications other than a mesh. For example, the metal wire may be used as single yarn of twisted yarn, such as plied yarn or covered yarn. Alternatively, the metal wire may be used for filament coils, for example. It can be used in various tungsten products that take advantage of the properties of tungsten, such as a high melting point and high hardness.

In addition, for example, one aspect of the present invention may be a method of manufacturing a metal wire having the features described above.

Additionally, embodiments arrived at by those skilled in the art making modifications to the above embodiment, as well as embodiments arrived at by combining various structural components and functions described in the above embodiment without materially departing from the novel teachings and advantages of the present invention are intended to be included within the scope of the present invention.

The invention claimed is:

1. A metal wire, the metal wire having:
a tungsten content of at least 90 wt %;
a rhenium content of at least 0.1 wt % and at most 10 wt %;
a total elongation of at least 5.5% and at most 16%;
a tensile strength of at least 1600 MPa and at most 2400 MPa; and
a diameter of 18 μm or less.

2. The metal wire according to claim 1, wherein
the metal wire is an alloy wire containing an alloy of tungsten and at least one type of metallic element different from tungsten.

3. The metal wire according to claim 2, wherein
each of the at least one type of metallic element is a Group 7 element or a Group 8 element.

4. The metal wire according to claim 1, wherein
the metal wire does not fracture when the metal wire is bent until an inner radius of curvature of the metal wire reaches a predetermined value of 13.6 μm or less.

5. The metal wire according to claim 1, wherein
the metal wire is used as warp or weft of a mesh.

* * * * *